US009821443B2

(12) United States Patent
Wang

(10) Patent No.: US 9,821,443 B2
(45) Date of Patent: Nov. 21, 2017

(54) RATCHET WRENCH

(71) Applicant: Compass Corporation, Annan District, Tainan (TW)

(72) Inventor: Tzu-Chien Wang, Tainan (TW)

(73) Assignee: COMPASS CORPORATION, Tainan (TW)

( * ) Notice: Subject to any disclaimer, the term of this patent is extended or adjusted under 35 U.S.C. 154(b) by 145 days.

(21) Appl. No.: 14/959,600

(22) Filed: Dec. 4, 2015

(65) Prior Publication Data

US 2017/0157755 A1 Jun. 8, 2017

(51) Int. Cl.
*B25B 23/00* (2006.01)
*B25B 13/46* (2006.01)

(52) U.S. Cl.
CPC ..... *B25B 23/0035* (2013.01); *B25B 13/463* (2013.01)

(58) Field of Classification Search
CPC ..... B25B 23/0035; B25B 13/463
USPC ..... 81/60, 63.2
See application file for complete search history.

(56) References Cited

U.S. PATENT DOCUMENTS 145,399 A * 12/1873 Colbert ..... B25B 13/466 411/392
1,493,983 A * 5/1924 Hurley ..... B25B 13/466 81/177.2
3,142,211 A * 7/1964 Faso ..... B25B 23/108 81/125
3,690,728 A * 9/1972 Krekeler ..... E21C 35/197 299/109
5,477,757 A * 12/1995 Maresh ..... B25B 13/465 81/63
7,082,861 B1 * 8/2006 Chen ..... B25B 13/463 81/63
RE42,816 E * 10/2011 Hu ..... B25B 13/463 81/58.1
9,406,423 B1 * 8/2016 Tsai ..... B25B 23/02
2016/0059394 A1 * 3/2016 Hu ..... B25B 23/0035 81/60

* cited by examiner

*Primary Examiner* — Hadi Shakeri

(57) ABSTRACT

A ratchet wrench includes a ratchet wheel received in a handle and having an insertion hole. The ratchet wheel further includes an outer periphery having a toothed portion and a lower section below the toothed portion. The lower section includes an annular engagement groove and a cutout intercommunicating the annular engagement groove with the insertion hole. A clip includes a notch and has a diameter slightly smaller than a spacing between upper and lower wall faces of the annular engagement groove and larger than a depth of the annular engagement groove. The clip is not on the same plane when placed flat. The maximum width between an upper edge and a lower edge of the clip is slightly larger than the spacing between the upper and lower wall faces of the annular engagement groove. The clip includes an engagement section received in the cutout and extending into the insertion hole.

3 Claims, 8 Drawing Sheets

RATCHET WRENCH

BACKGROUND OF THE INVENTION

The present invention relates to a ratchet wrench and, more particularly, to a ratchet wrench with improved assembly stability.

A type of conventional wrench includes a handle, a ratchet wheel, and a direction switching device. The ratchet wrench is mounted on the handle and can be controlled by the direction switching device to rotate in a clockwise direction or a counterclockwise direction. An insertion hole is defined in a center of the ratchet wheel for coupling with a tool, such as a bit, an extension rod, or the like. A magnet is mounted in the insertion hole for attracting the tool to prevent the tool from falling. However, the magnet has a low strength and is, thus, apt to damage or break when subjected to a large external force.

To avoid the above disadvantages, a clip has been proposed to replace the magnet. In an example shown in FIG. 8, a ratchet wrench includes a handle 1', a ratchet wheel 2', a direction switching device 3', and a clip 4'. A through-hole 11' is defined in an end of the handle 1', extends from a top side through a bottom side of the end of the handle 1', and receives the ratchet wheel 11'. A compartment 12' is defined in a sidewall of the through-hole 11' and receives the direction switching device 3'. The ratchet wheel 2' is substantially cylindrical and includes an outer periphery having a plurality of teeth 21'. The ratchet wheel 2' further includes an annular stop edge 22' above the teeth 21'. The diameter of the stop edge 22' is larger than the diameter of the through-hole 11'. The stop edge 22' abuts the top side of the handle 1'. The stop edge 22' includes an insertion hole 23' in a center thereof. The ratchet wheel 2' further includes a lower portion having two cutouts 24'. The direction switching device 3' is mounted in the compartment 12' and includes a pawl 31', a control button 32', a spring 33', and a pressing block 34'. The pawl 31' meshes with the teeth 21' of the ratchet wheel 2'. The control button 32' controls the pressing block 34' to press against the pawl 31' to thereby change the angular engagement relationship between the pawl 31' and the ratchet wheel 2', such that the ratchet wheel 2' can rotate in the clockwise direction or the counterclockwise direction. Two sides of the clip 4' are inserted in the cutouts 24' and can engage with an outer periphery of a tool 5' inserted into the insertion hole 23'.

However, a large spacing X could exist between the clip 4' and the upper and lower wall faces of the cutouts 24' due to different manufacturing quality and manufacturing tolerances, such that the clip 4' could move relative to the ratchet wheel 2' in the vertical direction and, thus, cause movement of the tool 5' in the vertical direction, leading to unstable engagement between the tool 5' and the ratchet wheel 2'. As a result, a bolt or a socket engaged with a front end of the tool 5' moves in the vertical direction, resulting in unstable engagement and inconvenience to operation. Furthermore, the stop edge 22' integrally formed on the top of the ratchet wheel 2' has a fixed shape and has the same color as the ratchet wheel 2', failing to provide an indicating function by the color or shape.

BRIEF SUMMARY OF THE INVENTION

An objective of the present invention is to provide a ratchet wrench with improved assembly stability.

Another objective of the present invention is to provide a ratchet wrench with improved indicating function.

A ratchet wrench according to the present invention includes a handle having top and bottom sides and a hollow portion extending from the top side through the bottom side. The handle further includes a compartment in a side of the hollow portion. A ratchet wheel unit includes a ratchet wheel and a clip. The ratchet wheel is substantially cylindrical and is received in the hollow portion of the handle. The ratchet wheel is rotatable relative to the handle. The ratchet wheel includes a central portion having an insertion hole. The insertion hole is circular in cross section in an upper portion and non-circular in cross section in a lower portion. The ratchet wheel further includes an outer periphery having an intermediate portion with a toothed portion. The outer periphery of the ratchet wheel further includes a lower section below the toothed portion. The lower section includes an annular engagement groove extending towards the insertion hole and having upper and lower wall faces. The lower section further includes a cutout intercommunicating the annular engagement groove with the insertion hole. The bottom side of the handle is located between the annular engagement groove and the top side of the handle. The clip is made of a flexible material and is annular. The clip includes a notch and has a diameter slightly smaller than a spacing between the upper and lower wall faces of the annular engagement groove and larger than a depth of the annular engagement groove. The clip is not on the same plane when placed flat. The clip includes a maximum width between an upper edge thereof and a lower edge thereof. The maximum width is slightly larger than the spacing between the upper and lower wall faces of the annular engagement groove. The clip includes an engagement section. The engagement section is received in the cutout and extends into the insertion hole when the clip is engaged and positioned in the annular engagement groove. A direction switching unit is mounted in the compartment of the handle. The direction switching unit is operable to control the ratchet wheel to rotate in a clockwise direction or a counterclockwise direction.

In an example, the notch is defined between the two ends of the clip, and the two ends of the clip are not located on the same plane.

The cutout of the ratchet wheel can be rectilinear. The annular engagement groove can be arcuate in the remaining portion thereof other than the cutout. The engagement section of the clip is rectilinear and has a length larger than a length of the cutout. The clip can further includes two arcuate sections. The notch is defined between the two arcuate sections. Each of the two arcuate sections is connected to one of two ends of the engagement section via a recessed portion. Each recessed portion is adapted to permit insertion of a tool.

The compartment of the handle can include a lower opening in a lower end thereof. The ratchet wheel unit can further include a lower cap mounted below the hollow portion of the handle. The lower cap includes a through-hole through which the lower section of the ratchet wheel extends. The lower cap further includes a covering portion covering the lower opening of the compartment. The lower cap includes a bottom face located above the annular engagement groove. The clip abuts the bottom face of the lower cap.

The handle can further include an upper annular wall extending from an upper end of an inner periphery of the hollow portion towards a center of the hollow portion. The upper annular wall includes a through-hole in a central portion thereof. The toothed portion of the ratchet wheel has a diameter larger than a diameter of the through-hole of the upper annular wall of the handle. The ratchet wheel unit can further include a rotational cap. The ratchet wheel can further include an upper section above the toothed portion. The upper section has a diameter slightly smaller than the diameter of the through-hole of the upper annular wall of the handle. The upper section of the ratchet wheel further includes a top extending above the upper annular wall. The top of the upper section has an annular inwardly extending retaining edge and an abutment side. The rotational cap is annular and is mounted around the top of the ratchet wheel. The rotational cap has an outer diameter larger than the diameter of the through-hole of the handle. The rotational cap further includes a coupling hole in a central portion thereof. The coupling hole includes an inner periphery having an engagement member engaged with the annular inwardly extending retaining edge of the ratchet wheel. The inner periphery of the coupling hole of the rotational cap further includes a stop side. The upper section of the ratchet wheel is received in the coupling hole of the rotational cap. The stop side of the rotational cap abuts against the abutment side of the upper section of the ratchet wheel for driving the ratchet wheel to rotate.

The rotational cap can be made of a plastic material.

The abutment side of the upper section of the ratchet wheel and the stop side of the rotational cap can be rectilinear.

The present invention will become clearer in light of the following detailed description of illustrative embodiments of this invention described in connection with the drawings.

DETAILED DESCRIPTION OF THE INVENTION

Figure 1:
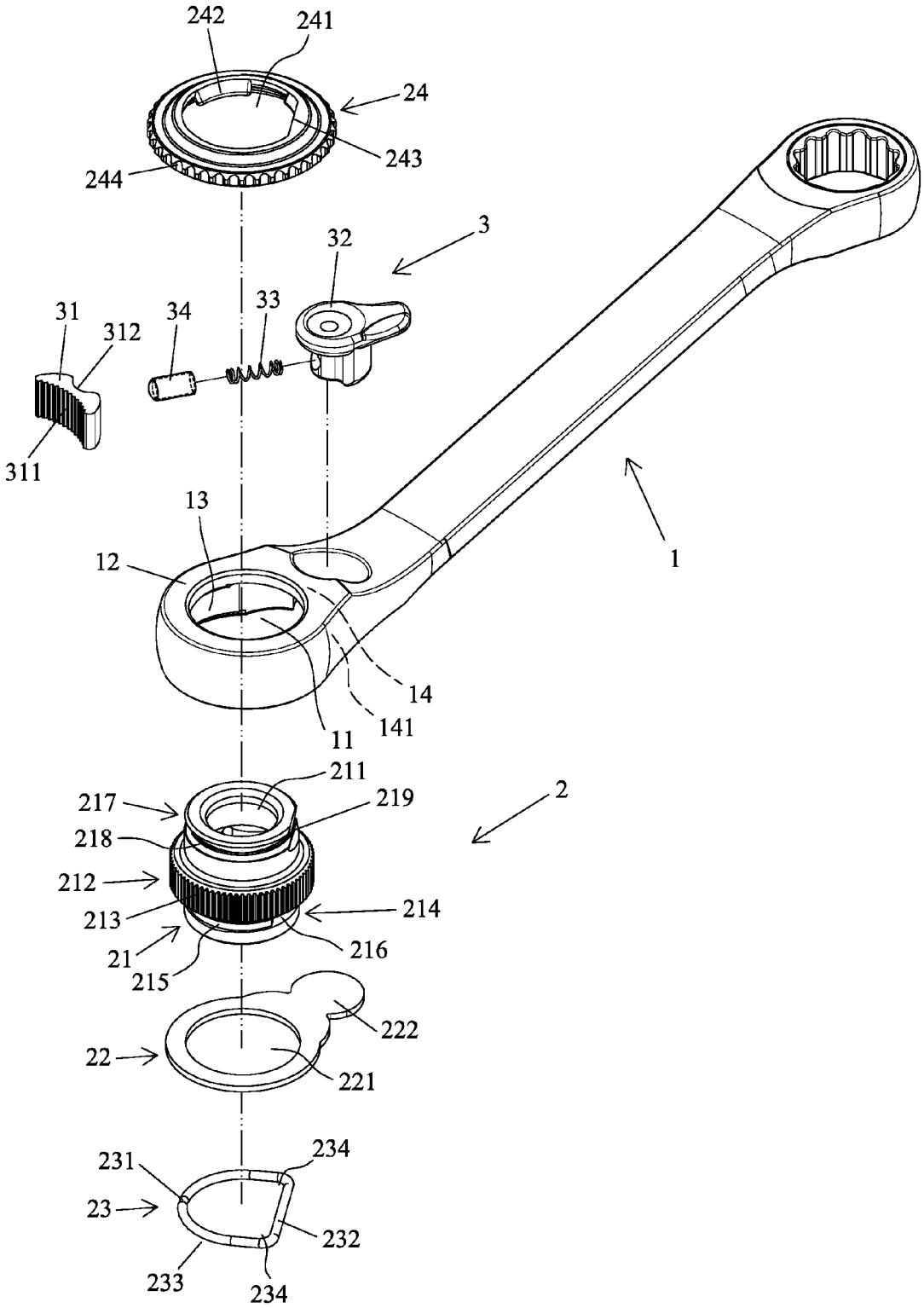
FIG. 1 is an exploded, perspective view of a ratchet wrench according to the present invention.
Figure 2:
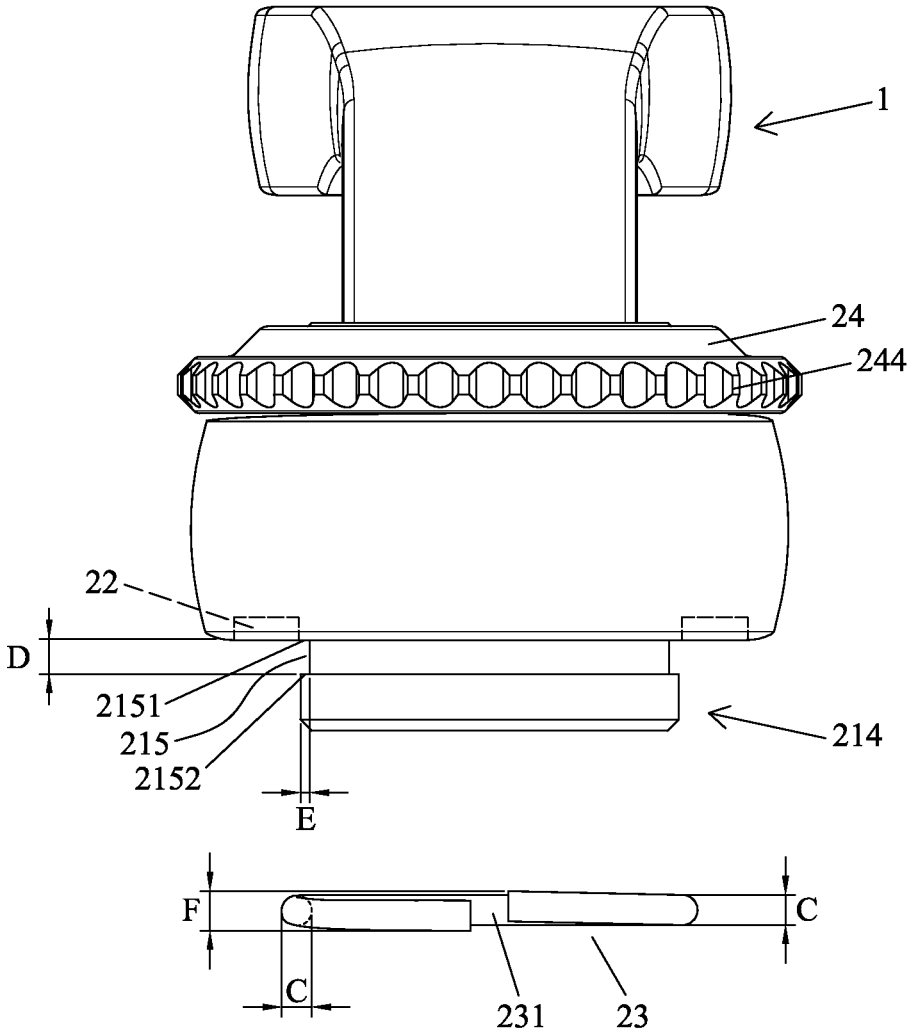
FIG. 2 is a left side view of the ratchet wrench of FIG. 1 with a clip not assembled.
Figure 3:
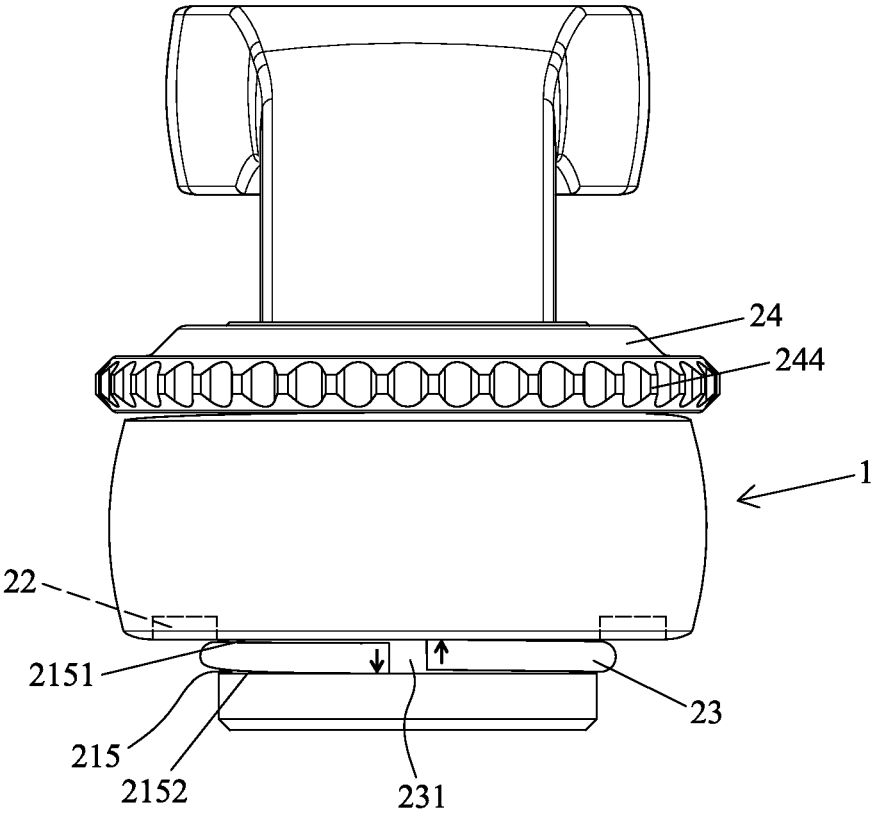
FIG. 3 is a left side view of the ratchet wrench of FIG. 1 with the clip assembled.
Figure 4:
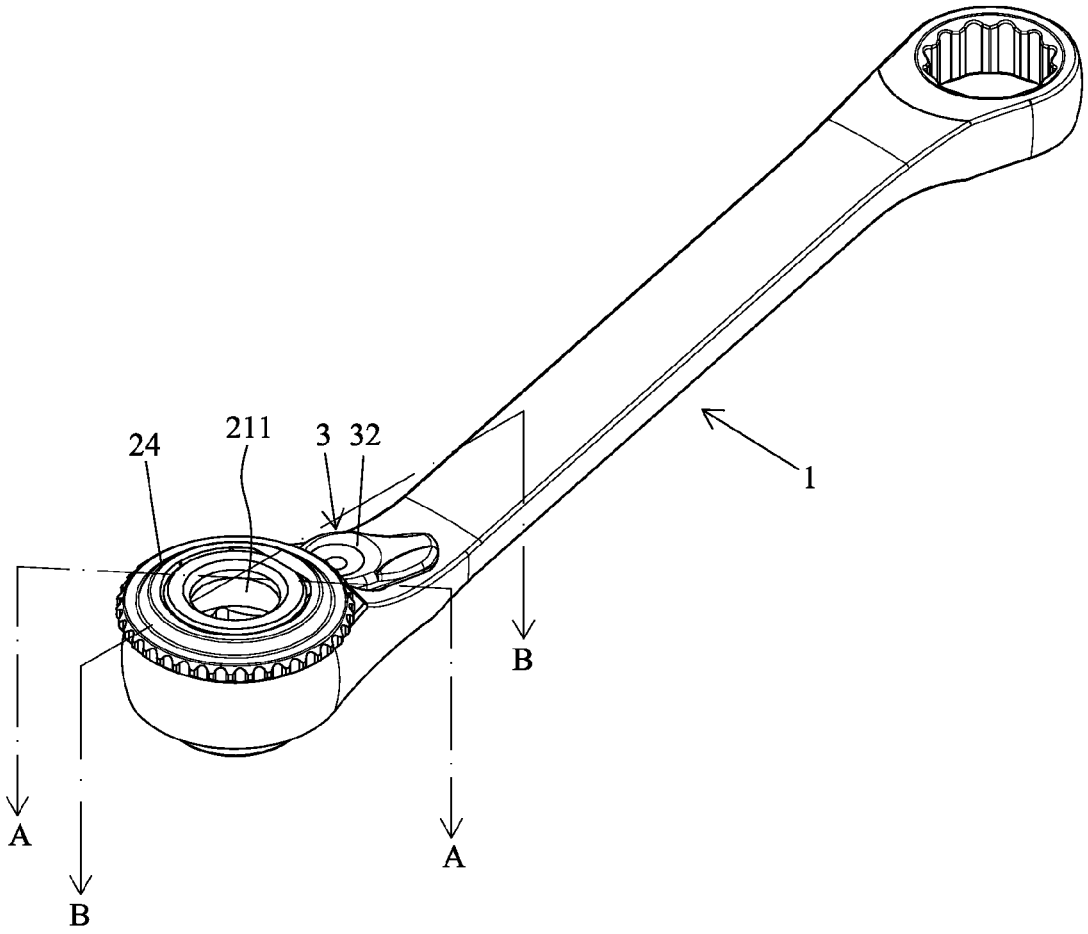
FIG. 4 is a perspective view of the ratchet wrench of FIG. 1 after assembly.
Figure 5:
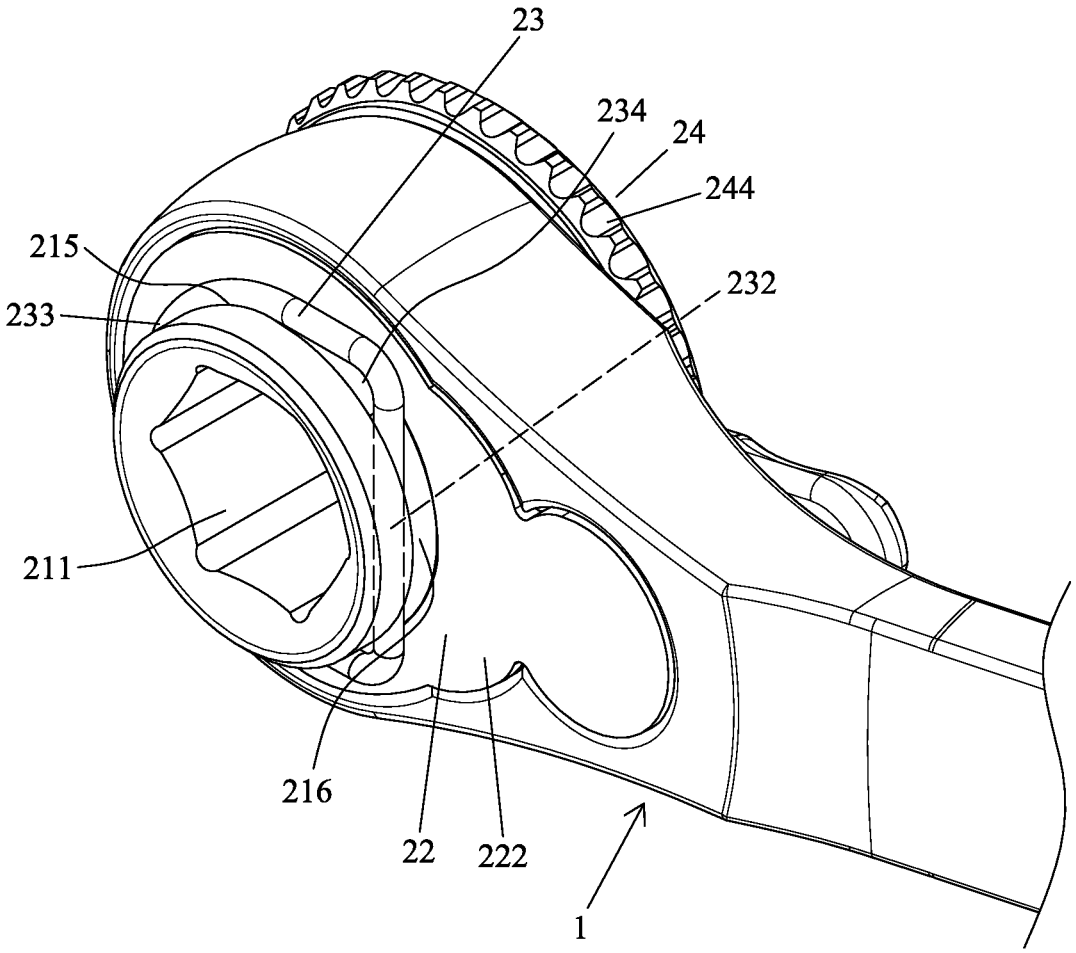
FIG. 5 is another perspective view of a portion of the ratchet wrench of FIG. 4.
Figure 6:
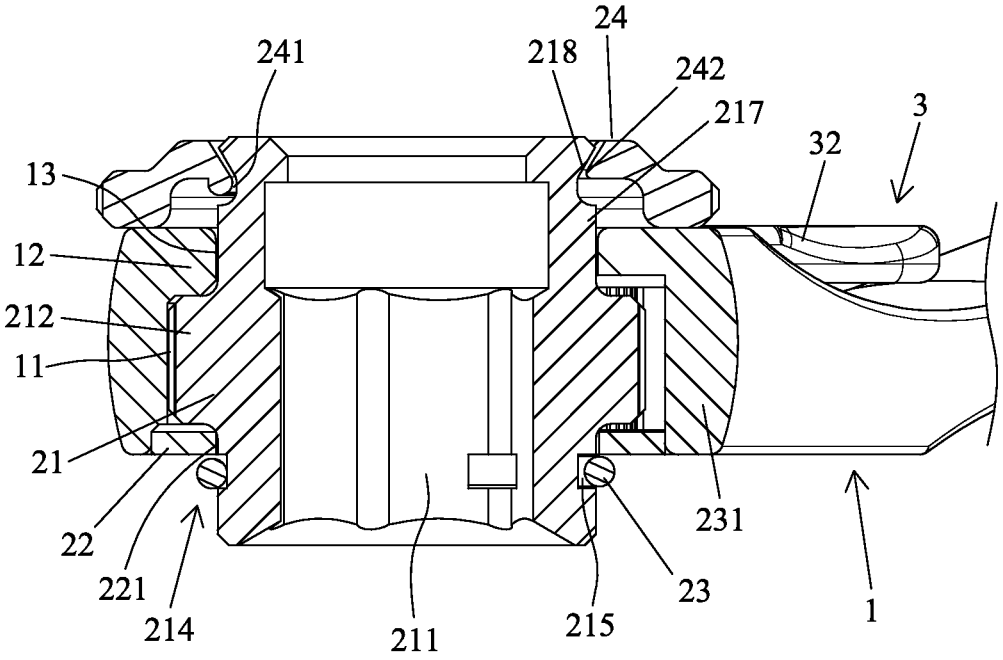
FIG. 6 is a cross sectional view taken along section line A-A of FIG. 4.

With reference to FIGS. 1-7, a ratchet wrench according to the preset invention includes a handle 1, a ratchet wheel unit 2, and a direction switching unit 3. The handle 1 includes top and bottom sides and a hollow portion 11 extending from the top side through the bottom side. The handle 1 further includes an upper annular wall 12 extending from an upper end of an inner periphery of the hollow portion 11 towards a center of the hollow portion 11. The upper annular wall 12 includes a through-hole 13 in a central portion thereof. The handle 1 further includes a compartment 14 in a side of the hollow portion 11. The compartment 14 includes a lower opening 141 in a lower end thereof.

The ratchet wheel unit 2 includes a ratchet wheel 21, a lower cap 22, a clip 23, and a rotational cap 24. The ratchet wheel 21 is substantially cylindrical and is received in the hollow portion 11 of the handle 1. The ratchet wheel 21 is rotatable relative to the handle 1. The ratchet wheel 21 includes a central portion having an insertion hole 211 which extends in an axial direction and which is non-circular in cross section. The ratchet wheel 21 further includes an outer periphery having an intermediate portion with a toothed portion 212. The toothed portion 212 has a diameter larger than a diameter of the through-hole 13 of the upper annular wall 12 of the handle 1. The toothed portion 212 includes a plurality of teeth 213 extending in the vertical direction and arranged in a circumferential direction. The outer periphery of the ratchet wheel 21 further includes a lower section 214 below the toothed portion 212. The lower section 214 includes an annular engagement groove 215 extending towards the insertion hole 211 and having upper and lower wall faces 2151 and 2152. The lower section 214 further includes a cutout 216 intercommunicating the annular engagement groove 215 with the insertion hole 211. The cutout 216 of the ratchet wheel 21 is rectilinear. The annular engagement groove 215 is arcuate in the remaining portion thereof other than the cutout 216. The bottom side of the handle 1 is located between the annular engagement groove 215 and the top side of the handle 1 when the ratchet wheel 21 is mounted in the hollow portion 11 of the handle 1. The ratchet wheel 21 further includes an upper section 217 above the toothed portion 212. The upper section 217 has a diameter slightly smaller than the diameter of the through-hole 13 of the upper annular wall 12 of the handle 1 and extends through the through-hole 13. The upper section 217 of the ratchet wheel 21 further includes a top extending above the upper annular wall 12. The top of the upper section 217 has an annular inwardly extending retaining edge 218 and an abutment side 219 that is rectilinear.

The lower cap 22 is mounted below the hollow portion 11 of the handle 1. The lower cap 22 includes a through-hole 221 through which the lower section 214 of the ratchet wheel 21 extends. The lower cap 22 further includes a covering portion 222 covering the lower opening 141 of the compartment 14. A bottom face of the lower cap 22 is located above the annular engagement groove 215 when the lower cap 22 is mounted below the through-hole 13 of the handle 1.

The clip 23 is made of a flexible material and is annular. The clip 23 includes a notch 231 and is substantially circular in cross section (see FIGS. 1 and 2). The clip 23 has a diameter C slightly smaller than a spacing D between the upper and lower wall faces 2151 and 2152 of the annular engagement groove 215 and larger than a depth of the annular engagement groove 215. The clip 23 is not on the same plane when placed flat. The clip 23 includes two ends between which the notch 231 is defined. Thus, the two ends of the clip 23 are not located on the same plane. The clip 23 includes a maximum width F between an upper edge thereof and a lower edge thereof. The maximum width F is slightly larger than the spacing D between the upper and lower wall faces 2151 and 2152 of the annular engagement groove 215. In the form shown, the clip 23 includes an engagement section 232. The engagement section 232 of the clip 23 is rectilinear and has a length larger than a length of the cutout 216. The clip 23 further includes two arcuate sections 233. The notch 231 is defined between the two arcuate sections 233. Each of the two arcuate sections 233 is connected to one of two ends of the engagement section 232 via a recessed portion 234. The recessed portions 234 are adapted to pear lit insertion of a tool with a pointed end.

The clip 23 can expand due to provision of the notch 231 and can be engaged in the annular engagement groove 215 of the ratchet wheel 21. The engagement section 232 is received in the cutout 216 and extends into the insertion hole 211 when the clip 23 is engaged and positioned in the annular engagement groove 215. An outer edge of each arcuate section 233 extends outside of the annular engagement groove 215 and abuts the bottom face of the lower cap 22 to prevent disengagement of the lower cap 22. When the clip 23 is engaged in the annular engagement groove 215, the upper edge and the lower edge of the clip 23 are compressed and respectively press against the upper wall face 2151 and the lower wall face 2152 of the annular engagement groove 215 (see FIG. 3), providing a positioning effect under the returning force of the clip 23 due to the flexibility of the clip 23.

The rotational cap 24 is mounted around the top of the ratchet wheel 21 and can be made of a plastic material or any outer suitable material. The rotational cap 24 can have a desired color according to need. The rotational cap 24 is annular and has an outer diameter larger than the diameter of the through-hole 13 of the handle 1. The rotational cap 24 further includes a coupling hole 241 in a central portion thereof. The upper section 217 of the ratchet wheel 21 is received in the coupling hole 241 of the rotational cap 24. The coupling hole 241 includes an inner periphery having an engagement member 242 engaged with the annular inwardly extending retaining edge 218 of the ratchet wheel 21. The inner periphery of the coupling hole 241 of the rotational cap 24 further includes a stop side 243 corresponding to the abutment side 219 of the upper section 217. The stop side 243 of the rotational cap 24 is rectilinear. The rotational cap 24 further includes a plurality of slip-preventing teeth 244 on an outer periphery thereof.

The direction switching unit 3 is mounted in the compartment 14 of the handle 1 and is operable to control the ratchet wheel 21 to rotate in a clockwise direction or a counterclockwise direction. The direction switching unit 3 includes a pawl 31, a control button 32, a spring 33, and a pressing block 34. The pawl 31 includes a first side having a toothed section 311 meshed with the toothed portion 212 of the ratchet wheel 21. The pawl 31 further includes a second side having a pressing face 312. The control button 32 is operable to actuate the spring 33 and the pressing block 34. The pressing block 34 includes an end pressing against the pressing face 312 of the pawl 31. The control button 32 controls an extent of angular movement of the pawl 31 and controls a rotating direction of the ratchet wheel 21. The structure of the direction switching unit 3 is conventional and, thus, not further described to avoid redundancy.

In assembly, the pawl 31, the spring 33, and the pressing block 34 of the direction switching unit 3 are inserted into the compartment 14 via the lower opening 141. The ratchet wheel 21 is mounted into the hollow portion 11 from below. A portion of the upper section 217 of the ratchet wheel 21 extends upwards beyond the through-hole 13. The coupling hole 241 of the rotational cap 24 is mounted around the upper section 217 of the ratchet wheel 21. The stop side 243 of the rotational cap 24 abuts against the abutment side 219 of the upper section 217 of the ratchet wheel 21. The engagement member 242 engages with the annular inwardly extending retaining edge 218 of the ratchet wheel 21. Thus, the rotational cap 24 can rotate the ratchet wheel 21 and can prevent the ratchet wheel 21 from falling downwards. The lower cap 22 is mounted below the ratchet wheel 21 with the covering portion 222 covering the lower opening 141 of the compartment 14. The clip 23 is engaged in the annular engagement groove 215 of the lower section 214 of the ratchet wheel 21. Due to the non-plane design of the clip 23, the clip 23 can be reliably positioned to the upper wall face 2151 and the lower wall face 2152 of the annular engagement groove 215. The engagement section 232 is engaged in the cutout 216. The recessed portions 234 are not located in the annular engagement groove 215. A portion of the clip 23 extends outside of the annular engagement groove 215 and abuts the lower cap 22 to prevent disengagement of the lower cap 22 while a portion of the engagement section 232 is received in the insertion hole 211.

Figure 7:
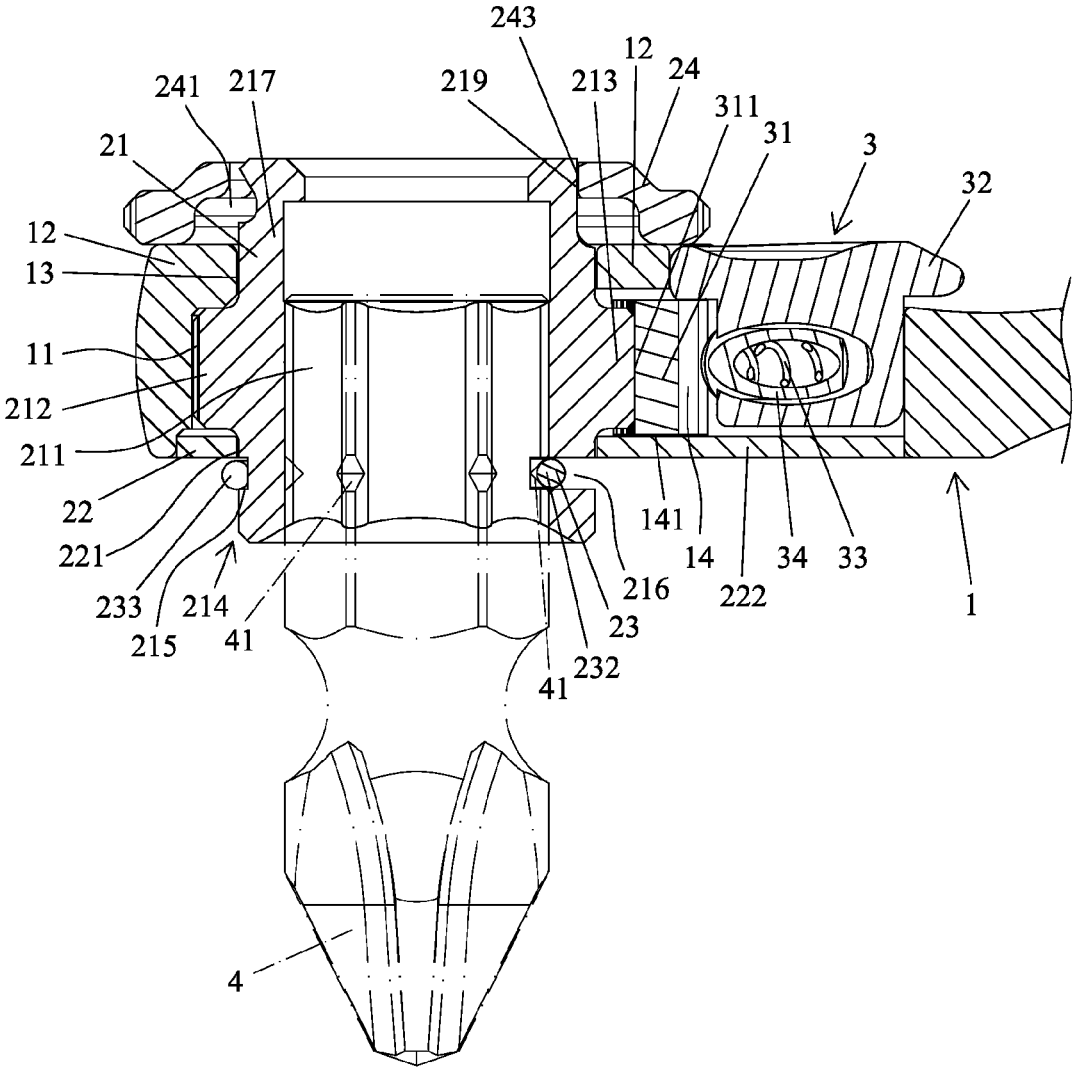
FIG. 7 is a cross sectional view taken along section line B-B of FIG. 4, illustrating coupling with a tool.
Figures 8, 8A:
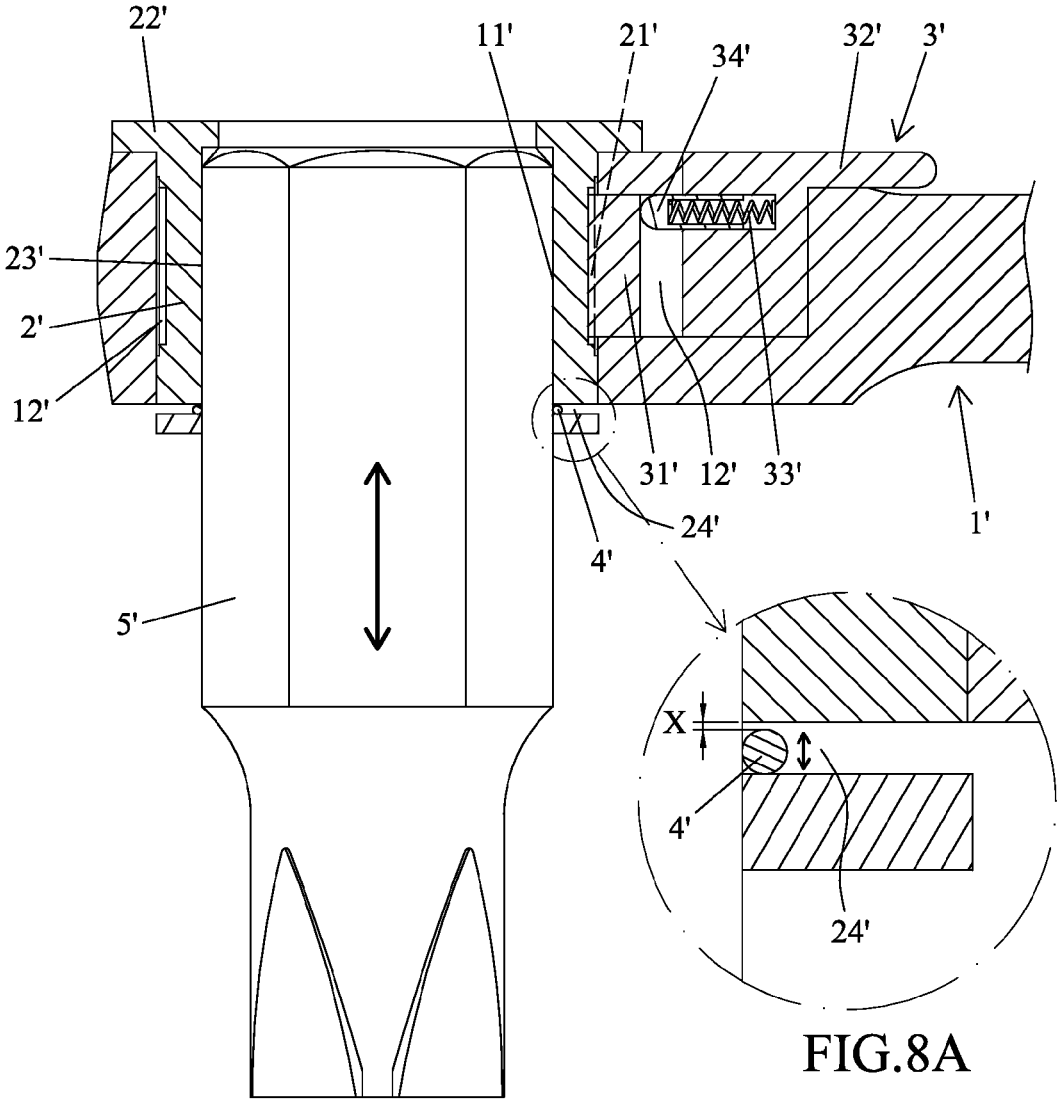
FIG.8A PRIOR ART
FIG. 8 is a partial, cross sectional view of a conventional ratchet wrench.
FIG. 8A is an enlarged view of a circled portion of FIG. 8.

With reference to FIG. 7, when a tool 4 in the form of a bit is inserted into the insertion hole 211, the engagement section 232 of the clip 23 is engaged in grooves 41 of the tool 4 to position the tool 4. Furthermore, the clip 23 is positioned by the annular engagement groove 215 without the risk of movement in the vertical direction, preventing vertical movement of the tool 4 relative to the ratchet wheel 21 and providing improved assembly stability and operational convenience. When it is desired to repair or replace elements of the ratchet wrench according to the present invention, the recessed portions 234 of the clip 23 permits insertion of a tool (not shown) with a pointed end to remove the clip 23, permitting easy repair and maintenance.

The clip 23 according to the present invention provides both functions of positioning the tool 4 and preventing disengagement of the lower cap 22. Furthermore, the rotational cap 24 according to the present invention can be made of a plastic material to provide a different color or a shape for indicating purposes, permitting easier visual identification.

When the diameter of the upper section 217 of the ratchet wheel 21 is larger than the diameter of the through-hole 13, the ratchet wrench does not have to include the rotational cap 24, and the ratchet wheel 21 is mounted from top. Furthermore, when the compartment 14 does not include the lower opening 141, the direction switching unit 3 is mounted in the compartment 14 via the hollow portion 11, and the ratchet wrench does not have to include the lower cap 22. Furthermore, the direction switching unit 3 can be replaced by any equivalent mechanism.

Although specific embodiments have been illustrated and described, numerous modifications and variations are still possible without departing from the scope of the invention. The scope of the invention is limited by the accompanying claims.

The invention claimed is:

1. A ratchet wrench comprising: a handle including top and bottom sides and a hollow portion extending from the top side through the bottom side, with the handle further including a compartment in a side of the hollow portion; a ratchet wheel unit including a ratchet wheel and a clip, with the ratchet wheel being substantially cylindrical and received in the hollow portion of the handle, with the ratchet wheel rotatable relative to the handle, with the ratchet wheel including a central portion having an insertion hole, with the insertion hole being non-circular in cross section in a lower portion, with the ratchet wheel further including an outer periphery having an intermediate portion with a toothed portion, with the outer periphery of the ratchet wheel further including a lower section below the toothed portion, with the lower section including an annular engagement groove extending towards the insertion hole and having upper and lower wall faces, with the lower section further including a cutout intercommunicating the annular engagement groove with the insertion hole, with the bottom side of the handle located between the annular engagement groove and the top side of the handle, with the clip made of a flexible material and being annular, with the clip including a notch and having a diameter slightly smaller than a spacing between the upper and lower wall faces of the annular engagement groove and larger than a depth of the annular engagement groove, with the clip being not on a same plane when placed flat, with the clip including a maximum width between an upper edge thereof and a lower edge thereof, with the maximum width being slightly larger than the spacing between the upper and lower wall faces of the annular engagement groove, with the clip including an engagement section, with the engagement section received in the cutout and extending into the insertion hole when the clip is engaged and positioned in the annular engagement groove; and a direction switching unit mounted in the compartment of the handle, with the direction switching unit operable to control the ratchet wheel to rotate in a clockwise direction or a counterclockwise direction, with the handle further including an upper annular wall extending from an upper end of an inner periphery of the hollow portion towards a center of the hollow portion, with the upper annular wall including a through-hole in a central portion thereof, with the toothed portion of the ratchet wheel having a diameter larger than a diameter of the through-hole of the upper annular wall of the handle, with the ratchet wheel unit further including a rotational cap, with the ratchet wheel further including an upper section above the toothed portion, with the upper section having a diameter slightly smaller than the diameter of the through-hole of the upper annular wall of the handle, with the upper section of the ratchet wheel further including a top extending above the upper annular wall, with the top of the upper section having an annular inwardly extending retaining edge and an abutment side, with the rotational cap being annular and mounted around the top of the ratchet wheel, with the rotational cap having an outer diameter larger than the diameter of the through-hole of the handle, with the rotational cap further including a coupling hole in a central portion thereof, with the coupling hole including an inner periphery having an engagement member engaged with the annular inwardly extending retaining edge of the ratchet wheel, with the inner periphery of the coupling hole of the rotational cap further including a stop side, with the upper section of the ratchet wheel received in the coupling hole of the rotational cap, and with the stop side of the rotational cap abuts against the abutment side of the upper section of the ratchet wheel for driving the ratchet wheel to rotate.

2. The ratchet wrench as claimed in claim 1, wherein the rotational cap is made of a plastic material.

3. The ratchet wrench as claimed in claim 1, wherein the abutment side of the upper section of the ratchet wheel and the stop side of the rotational cap are rectilinear.

* * * * *